United States Patent [19]

Waterston

[11] 3,995,435

[45] Dec. 7, 1976

[54] FLUID FLOW CONTROL MEANS

[75] Inventor: William Waterston, Dunedin, New Zealand

[73] Assignee: G. Methven & Co., Limited, South Dunedin, New Zealand

[22] Filed: May 21, 1975

[21] Appl. No.: 579,594

[30] Foreign Application Priority Data

Nov. 27, 1974 New Zealand ..... 174375

[52] U.S. Cl. ..... 61/12; 61/18; 61/22 R; 61/25; 137/527.6; 251/147

[51] Int. Cl.[2] ..... E02B 13/00; F16K 17/12; E02B 7/40

[58] Field of Search ..... 61/12, 13, 23, 22, 25, 61/27, 29, 18, 17; 137/527.6, 527.8; 251/147

[56] References Cited

UNITED STATES PATENTS

| | | | |
|---|---|---|---|
| 635,206 | 10/1899 | Taylor | 61/25 |
| 1,166,991 | 1/1916 | Jones | 61/25 |
| 3,114,243 | 12/1963 | Winters | 61/12 |
| 3,710,821 | 1/1973 | Turetsky et al. | 137/527.8 |

*Primary Examiner*—Jacob Shapiro
*Attorney, Agent, or Firm*—Holman & Stern

[57] ABSTRACT

A fluid flow control means particularly for controlling water flow in irrigation systems such as open course or socalled "Border Dyke" systems in which there are a series divided land areas to be irrigated in turn. There being a control means at each division and each control means includes a flap member pivotally suspended across the flow path of the water so as to be movable in controlling the water flow, and a collapsible chamber (which can be defined by a bellows arrangement) arranged to act on and effect movement of the flap member, there being an inlet to the chamber or bellows in communication with the upstream side of the water course and an outlet arranged to enable water to flow from the chamber or bellows at a greater rate than into the chamber or bellows, and secondary control valve means actuable to close off said outlet in response to the existence of a predetermined amount or level of water at a predetermined position downstream of the flap, so that water is allowed to accumulate in the chamber or bellows and cause a force to act on the adjacent face of the flap member and move such flap member to a position closing off or at least restricting the water flow. The invention also includes irrigation systems incorporating the control means.

22 Claims, 11 Drawing Figures

FLUID FLOW CONTROL MEANS

FIELD OF THE INVENTION

The present invention relates to fluid flow control means enabling the opening up or closing off of a flow of fluid such as water and is particularly suitable for use in controlling a flow of water in damming, drainage and irrigation systems, whether as open water or water flowing in pipe lines and conduits.

BACKGROUND OF THE INVENTION

One particularly useful application of the fluid flow control means according to the present invention is in an open course or a so-called "Border Dyke" irrigation system into which it may be incorporated to produce an automatically actuated system which overcomes the disadvantages of prior arrangements requiring either the manual opening of control valves or race gates for supplying water to the irrigated areas or the setting of special timing and alarm systems.

It is envisaged that the need to effect constant or repeated inspection of an irrigated area can be avoided by the provision in the system of a fluid flow control means according to the present invention, of a liquid or moisture sensing means or float control or other level sensing means in the irrigated area to activate the fluid flow control.

Whereas it is envisaged that a very practical use of the fluid flow control means according to the present invention is in such an automatically operating irrigation system to control the race gates thereof, it is to be appreciated that its use is not necessarily limited to such purposes. For example it may be applied for drainage purposes, in which the sensing of moisture or water level on either side of a control gate can actuate the control. Alternatively the flow control could be applied to the damming of a river or stream using water pressure to close off the flow.

SUMMARY OF THE INVENTION

According to one aspect of the present invention a fluid flow control means comprises a flap member mountable across the flow path of the fluid which is to be controlled, and movable to effect control of said flow, at least one collapsible member defining a collapsible chamber and arranged to act on said flap member, the or each said chamber having an inlet means in flow communication with the upstream flow (either directly or from a position some distance upstream) and an outlet means arranged to enable the fluid flow leaving the chamber(s) to be greater than the fluid flow into the chamber(s), secondary control means actuable to close off said outlet in response to the existence of a predetermined amount or level of fluid at a predetermined position downstream of said flap member, so that fluid is able to accumulate in the chamber(s) and the accumulated fluid is able to act on an adjacent face of said flap member and to move said flap member to a position closing off or substantially retarding said fluid flow.

In one arrangement envisaged the flap member comprises a substantially non-flexible sheet member pivotally mounted across a flow conduit, and having a collapsible flexible member, such as a bellows or bag engaged against its downstream face and an inlet conduit or bore passing through the first member feeding upstream fluid into the collapsible member. The sheet member is to act in the form of a flap valve at the mouth of an opening or conduit, the fluid flow impinging on the upstream face of the sheet member opening the flap valve, the flap valve being closed by an opposing force produced by an accumulation of the fluid within the collapsible member. A further member is provided to the other side of the collapsible member and fixed relative to the flap to restrain the collapsible member from movement away from the flap such that the water accumulated on the collapsible member will act on the downstream face of the flap against which it rests or to which it is attached. The fixed member acting as a restraining means is so mounted that its fixed position can be adjusted by manual means toward or away from the collapsible member to adjust the closing position of the flap or to enable the complete closing down of the flow control means of the invention if desired. An outlet is provided from the collapsible member and the inlet and outlet are so arranged that the fluid flow through the outlet from the collapsible member is greater than the flow through the inlet into the collapsible member. An outlet connection is taken from the outlet for the collapsible member to a control valve positioned downstream of the flap, the valve being actuated by suitable means to close off the outlet connection and enable the fluid entering the collapsible member to accumulate and to act on the downstream face of the flap either by virtue of the weight of the water accumulating therein or the pressure build-up within the collapsible member, or a combination of these two forces, the closing of the flap being against the pressure of the fluid flow acting on the upstream face of the flap. The respective pressure areas on both sides of the flap are suitably arranged to enable this to be effected efficiently, with the downstream pressure area being greater than the upstream pressure area.

Opening of the member forming the flap to enable the flow to continue can be effected once the control valve downstream of the control means of the invention has been activated to open the outlet and to enable the drainage therethrough of the fluid accumulated in the flexible member.

It is also envisaged that for some applications of the fluid flow control means of the present invention an additional or secondary collapsible member can be provided on the upstream face of the member forming the flap and which is connected by an inlet pipe to the upstream flow of water in a similar manner to the first-mentioned or main collapsible member on the downstream side of the flap. An outlet from the secondary collapsible member enabling greater discharge therefrom than the inflow is drained by a connection which is connected to the control valve controlling the outlet from the main collapsible member, the control valve being arranged to actuate one way or the other to close off the flow from one outlet while the other is opened, and vice versa.

It is also envisaged that the flow control means of the present invention may be in other forms, for example, said flap member may be formed as a portion of the flexible collapsible member itself, which is in the form of a bag for example, and which is retained to extend across a valve seat for the fluid flow, and the build-up of fluid pressure within the bag through an inlet provided in the wall of the bag, when the outlet therefrom has been closed, will press the portion of the bag forming the flap member against the valve seat to close off the fluid flow.

In order that the invention may be more readily understood, several embodiments of the fluid flow control means according to the present invention are described below by way of example only in conjunction with the accompanying drawings, in which:

DESCRIPTION OF PREFERRED EMBODIMENTS OF THE INVENTION

Figure 1:
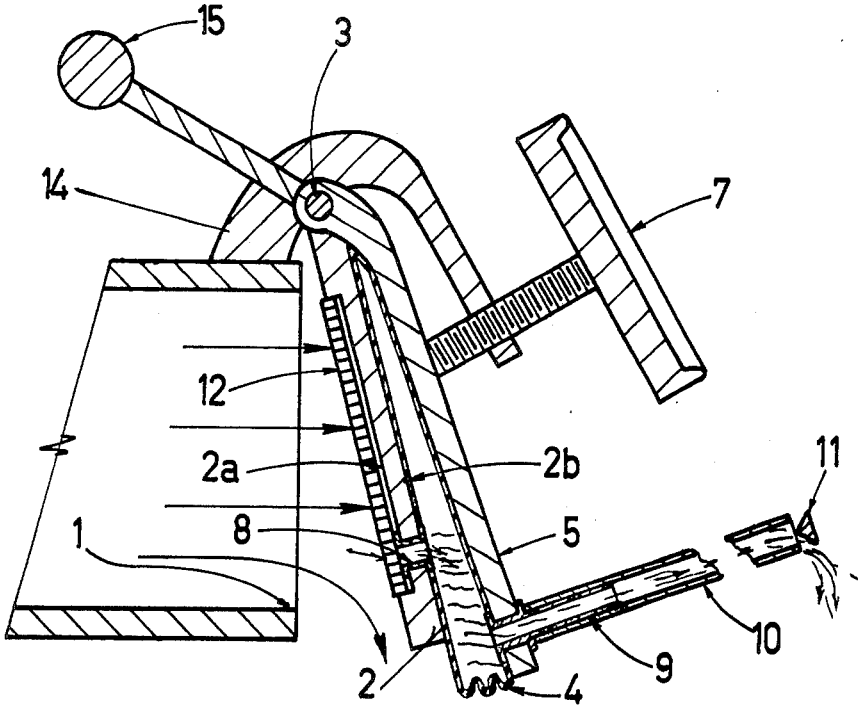
FIG. 1 is a diagrammatic sectional view of a flow control means according to the present invention in the open or flow position.
Figure 2:
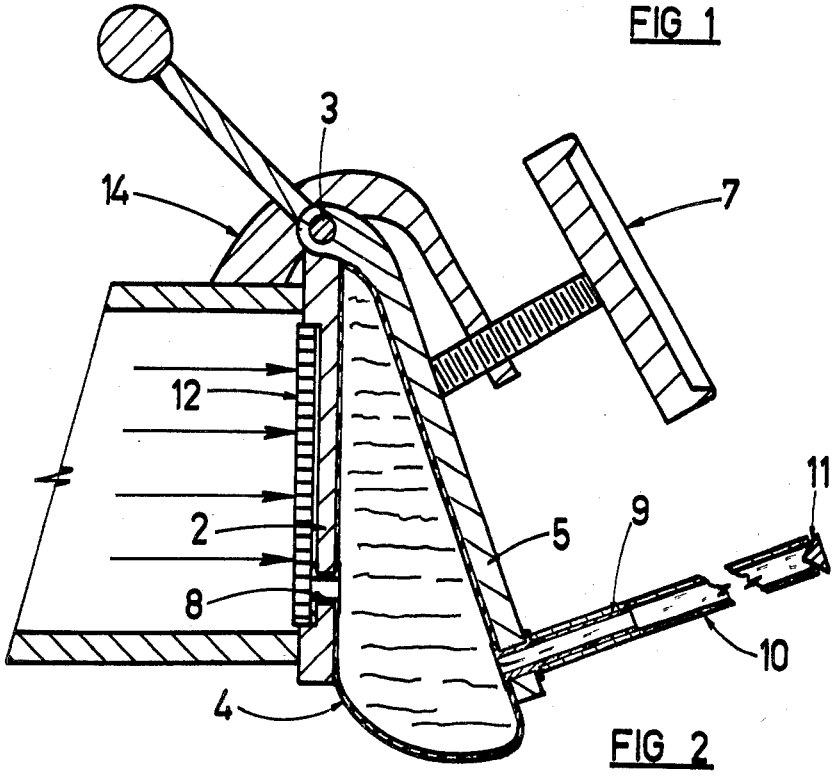
FIG. 2 is a diagrammatic sectional view of the means according to the present invention shown in FIG. 1 in the closed or non-flow position.
Figure 3:
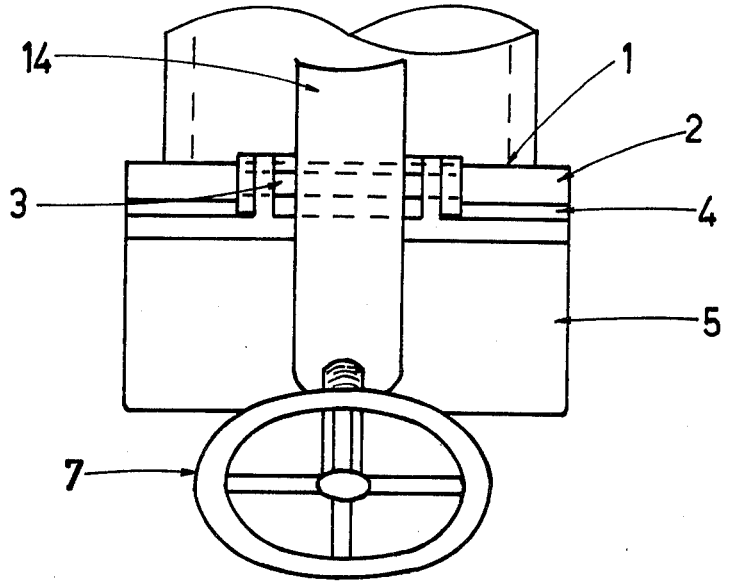
FIG. 3 is a diagrammatic plan view of the fluid flow control means shown in FIG. 2.

In the embodiment of the fluid flow control means according to the invention shown in FIGS. 1–3, the arrangement is shown connected near the opening 1 of a conduit however it will be appreciated that the fluid flow control means according to the present invention may be engaged adjacent any suitable opening through which the fluid to be controlled is arranged to flow. A substantially non-flexible member 2, preferably in the form of a sheet or plate member is mounted across the opening substantially transverse of the fluid flow. Its point of attachment to a support 14 is preferably by means of a hinge pin 3 at its upper end in the manner of a flap to enable it to pivot to and fro to close off or open the openings 1 and thus prevent or allow the fluid flow therethrough. The fluid flow will impinge on the upstream face 2*a* of the flap member 2. The downstream face 2*b* is associated with a collapsible flexible member 4, being preferably in the form of a flexible bag or bellows, for example, which may either be attached to the downstream face 2*b* of the flap or rest in contact therewith. A substantially rigid member 5, which may also be a plate member, is provided against which the other side of the collapsible member 4 may engage or be attached, which member 5 acts as restraining means for movement of the collapsible member. The member 5 is normally fixed but its position is adjustable about hinge 3 by manual control 7, such as a screw adjustment member, to enable the variation in the opening position of the flap member 2 or if desired to completely close down the flap member 2 against the opening 1 to stop the flow. An inlet 8 is provided communicating the fluid flow on the upstream side of flap 2 with the interior of the collapsible member 4 and an outlet 9 is provided from the collapsible member 4. The outlet could alternatively be provided hanging from the bottom of the bag itself. In the arrangement shown in FIG. 1 the inlet 8 is in the form of a pipe or passage extending through the flap member 2 and the adjacent wall of the collapsible member 4 and the outlet 9 is in the form of a pipe or passage through the restraining member 5 and the opposed wall of the collapsible member 4. The inlet 8 and the outlet 9 are so arranged, such as, for example, by providing them with different diameters, that the flow capacity of the inlet is less than the flow capacity of the outlet. A smaller diameter for the inlet 8 would be the simplest method of doing this, but other forms of flow check means could be incorporated in association with the inlet 8 and outlet 9 to provide this effect.

The inlet 8 is preferably provided near the lower end of the flap member 2 to ensure flow into the collapsible member 4 through the opening 1 even with low water levels. An outlet conduit or the like 10 extending from the outlet 9 is provided with a suitable control valve (not shown in detail but indicated diagrammatically at 11 in FIGS. 1 to 3) is provided at a position along the length of the conduit 10 remote from outlet 9 and arranged to close off the conduit 10 and hence to close off the discharge fluid from the collapsible member 4 as required. A filter member 12 is preferably positioned attached to the upstream side of the flap 2 either in connection with or spaced from the face 2*a* thereof. The inlet 8 is on the downstream side of the filter 12.

FIG. 1 shows the flap member 2 in the open position. The head of fluid acting on the upstream face 2*a* of the flap member 2 holds open the flap member 2 in opposition to any pressure of fluid within the collapsible member 4 and/or the weight of such fluid, the collapsible member 4 being relatively empty in view of the greater discharge from the outlet 9 than inflow at the inlet 8.

It is preferable that the pressure area over which the pressure build-up in the collapsible member 4 acts on the downstream face 2*b* of the flap member 2 be greater than the pressure area on face 2*a* on which the fluid flow at opening 1 acts when the flap member 2 is fully closed. This tends to enable the shutting of the flap member 2 with greater ease.

It is envisaged that where the pressure build-up of the fluid within the collapsible member 4 is relied upon to close the flap member 2 against opening 1 then a more positive closing action will be provided than where the weight of the water alone is relied upon.

It may be suitable to provide a support (not shown) carried by the lower end of the flap 2 on which the lower portion of the collapsible member 4 may rest when it becomes extended by the weight of water contained therein.

The control valve and valve operating means for outlet conduit 10 is envisaged to be provided in various forms, one particular form being a flow control valve mounted remote from the outlet 9 in the area to which the water is intended to reach, for example, an area being irrigated. Some forms of control valve envisaged are the flow control devices of the kind described in our U.S. Pat. No. 362,764, which include the employment of a moisture sensitive or hydro-philic element which readily absorbs moisture and swells and so doing effects closure of a fluid passage, whereby when moisture is sensed by the device it will close off flow through conduit 10 enabling the fluid to build up in collapsible member 4. A modification of the control devices of U.S. Pat. No. 362,764 includes the employment of a porous flexible or expansible bag or container containing a loose fill hydro-philic or water absorbing and swelling material in place of a unitary moisture sensitive element. Another form of control for outlet 9 is a float-operated valve or an electric solenoid-operated valve, a float-operated valve with a hydraulic linkage (not shown), namely a float mounted on a float arm in the area to be watered, which on rising pressurizes a bellows or the like collapsible means containing liquid to pass pressure along a connecting conduit back to a further bellows or the like positioned near the outlet 9, which further bellows acts upon a spring-biased valve member in conduit 10 or in the outlet 9 to close off the outlet 9.

Figure 5:
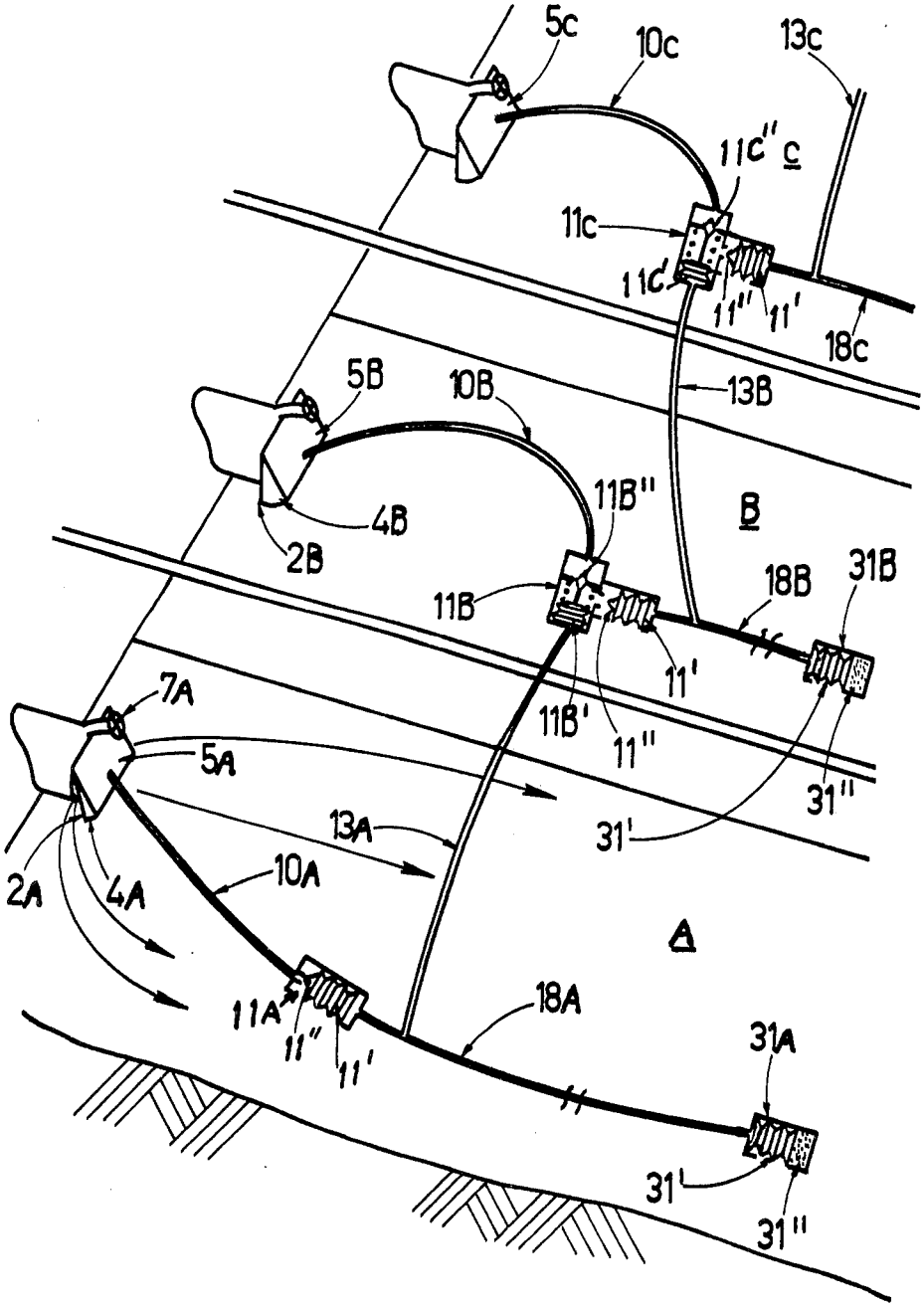
FIG. 5 is a more detailed, but still diagrammatic, view illustrating an arrangement of sensing and control means for effecting operation of a series of main flow control means such as shown in FIG. 4.

Many and various methods of controlling the discharge from outlet 9 are envisaged within the scope of the invention, and in one example, as illustrated in FIG. 5, a control device 31A downstream from control valve 11A includes a housing containing a bellows 31' and a hydro-philic or moisture absorbing and swelling element 31'' (which term element includes a porous container containing loose fill hydro-philic material) arranged to act on and compress the bellows 31' on absorption of water reaching the area in which it is located, the bellows 31' being connected by conduit 18A to a second bellows 11' supported at outlet conduit 10, compression of bellows 31 effecting extension or expansion of bellows 11' to close a valve member 11'' into or onto outlet conduit 10. Drying out of the moisture sensitive element 31'' (or contained loose fill material) permitting expansion of bellows 31' and collapsing of bellows 11' to open valve member 11'' and permit opening of the flap 2 for further discharge of water. Bellows 31' and 11' and connecting conduit 18A contain a liquid for effective hydraulic pressure action.

It is also envisaged that the fluid flow control means, according to the present invention, as shown in FIG. 1, may be releasably mounted by hinge pin 3 to the mounting or support 14, which may itself be detachably mounted adjacent the opening 1. When the fluid flow control means is arranged in the open, for example, as a race gate, this will enable its temporary removal at a time when irrigation is not required or for use elsewhere and thus will prevent damage by curious cattle and more economic use of the race gate.

It is also envisaged that a counter-balance, such as shown in FIG. 1 at 15, may be provided connected to the pivotally mounted upper end of the flap member 2 to provide more positive opening. Furthermore a float (not shown) could be provided attached to the upper part of the upstream face of the flap member 2 to provide a more positive closure to the flap member 2 in certain conditions.

Figure 4:
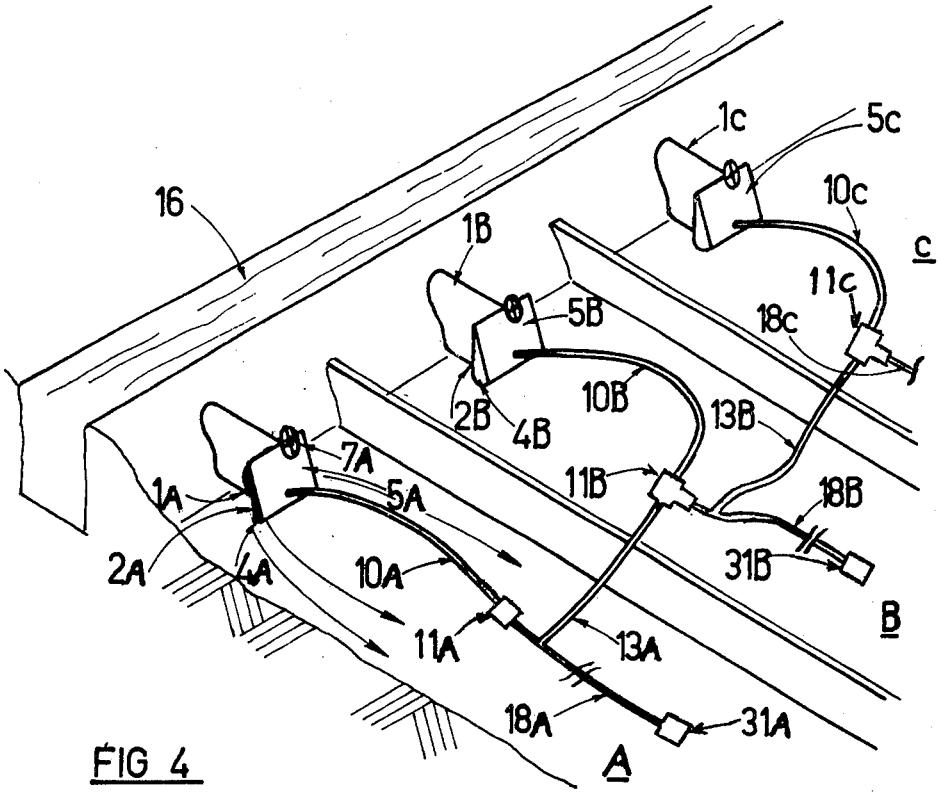
FIG. 4 is a diagrammatic perspective view of a level water race of the Border Dyke type in which a series of the flow control means according to the present invention are applied.

The use of a particular form of fluid flow control means according to the present invention described above can be applied to various irrigation systems, one of which is shown in FIGS. 4 and 5 by way of example only.

FIGS. 4 and 5 show the application of the fluid flow control means of the present invention to a level water race 16 provided with a series of border dykes 17 leading from the race and segregating the adjacent land into borders or paddocks A, B, C etc., in between which outlets 1A, 1B, 1C, etc., from race 16 allow water to flow and race gates controlling each outlet in sequence are each formed by a fluid flow control means according to the present invention. In this arrangement, the flow control means of FIGS. 1–3 is shown, by way of example only, fitted onto the outlet pipe 1A, 1B etc., with an extra conduit 13A, 13B, 13C etc., extending between the control valve 11A and control device 31A of the first race gate to the control valve 11B and control device 31B of the second race gate, and from the control valve 11C and control device 31C of the third race gate, and so on to the end of the gates to be controlled in sequence.

The control valving is arranged so that all the control valves other than the one controlling the first race gate are in a normally closed position.

When the first race gate control valve 11A is actuated and valve 11' closed by compression of bellows 31,' the actuating force also transmits a pressure via the pipe line 13A and expands a further bellows 11B' which in turn opens a valve member 11B'' in control valve 11B of the second race gate and so opens outlet 10B and opens flat 2B of this race gate. When the water level sensing or control device 31B for the second race gate is actuated by water in race B it closes its control valve 11' to close flap 2B and also sends a hydraulic pressure via pipeline 13B to open the control valve 11C of the third race gate, control valve 11C (and subsequent control valves of a series of races) being similar in construction and operation to control valve 11B.

The sequence control relies on the separate hydraulic linkage of the control valves 11 where the sensor or control device 31 used transmits a pressure to both its own gate control valve and to the control valve of the next gate. It shuts the control on its own gate and opens the control on the next gate which was spring loaded shut. This next control valve is later shut by its own sensory hydraulic pressure at a point downstream of the valve opened by the first sensory hydraulic pressure. The member 31'' of the sensor or control device 31 which swells in the sensor has its swelling movement converted to a hydraulic pressure by forcing the adjacent bellows 31' to close. As the members 31' in the sensors or control devices 31 take some hours to dry, all irrigations should be completed before the first sensor relaxes and opens the first gate.

According to current farming practice, irrigation is normally carried on for two days every month or every fortnight and the paddocks to be irrigated will normally be dry when water is fed into the level race 16. Therefore any control valves 11A, 11B, etc. and their associated water sensors or control devices 31A, 31B, etc., in the paddocks will have activated the outlet 9A, 9B, etc., of the collapsible members 4A, 4B, etc. to be fully open. Normally the amount of water fed through the water race 16 is arranged to be sufficient to feed one border or paddock at a time so that the water will get to the end of the first paddock A before the flow through outlet 1A stops. However, since initially the race gates on outlets 1A, 1B, etc., are all in the open position because of the dry condition of the paddocks A, B, etc., some water will flow through outlets 1B and 1C until the bags 4B and 4C are filled to close off the flaps 2B and 2C thereof and thus close off the flow through inlets 1B and 1C.

The closing of the gates is effected when the required supply of water has filled the paddocks and the sensing means in the paddocks have actuated the control valves 11A, 11B, etc., to close off the outlets 9A, 9B, etc., and hence cause the race gates to close.

It is envisaged that the fluid flow control means when applied to race gates may be so connected and so arranged to work one with the other such as to give various modes of operation whether together or in sequence one after the other or in other ways.

To control the distance the water travels in the paddock, where level or slightly inclined paddocks are involved, float-operated or other moisture sensing valves can be positioned near the end of the water travel. These float-operated or water sensing valves turn off the flow from the outlets 9 either near the float valve or actuate a hydraulic linkage which closes a control valve positioned close to the outlet 9.

One automatic flow control system envisaged at present uses the flow control device described in our U.S. Pat. No. 362,764 to sense the need for watering and to open the gates to begin the water supply, and to close off the flow when the moisture absorbing element thereof has expanded sufficiently.

It is also envisaged that flow control valves could be positioned down the length of the paddock or alternatively time control of the race gates could be provided actuated by fluid sensing means according to U.S. Pat. No. 362,764 acting as the secondary control means if a float control means failed.

Figure 6:
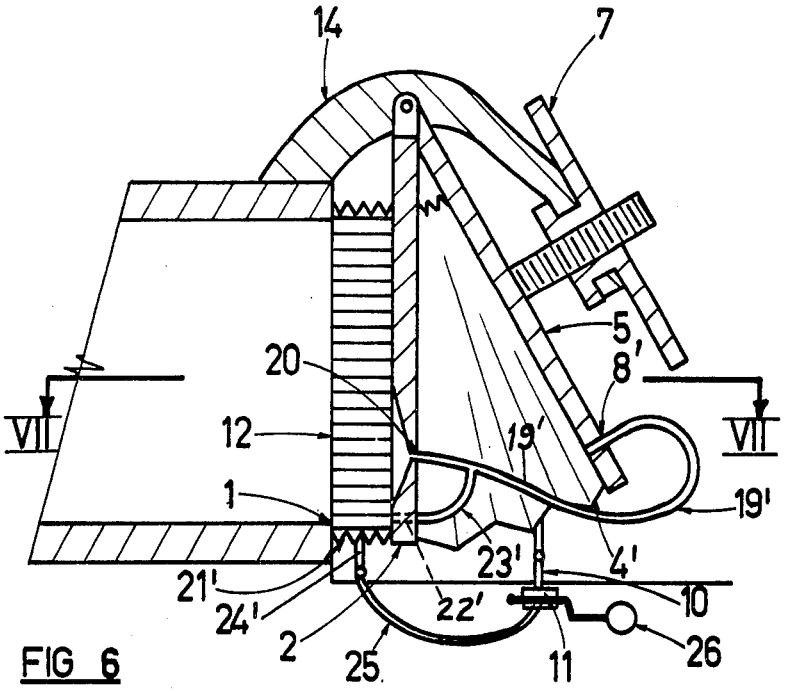
FIG. 6 is a diagrammatic mid-sectional view of a further form of fluid control means according to the present invention in the closed position.
Figure 7:
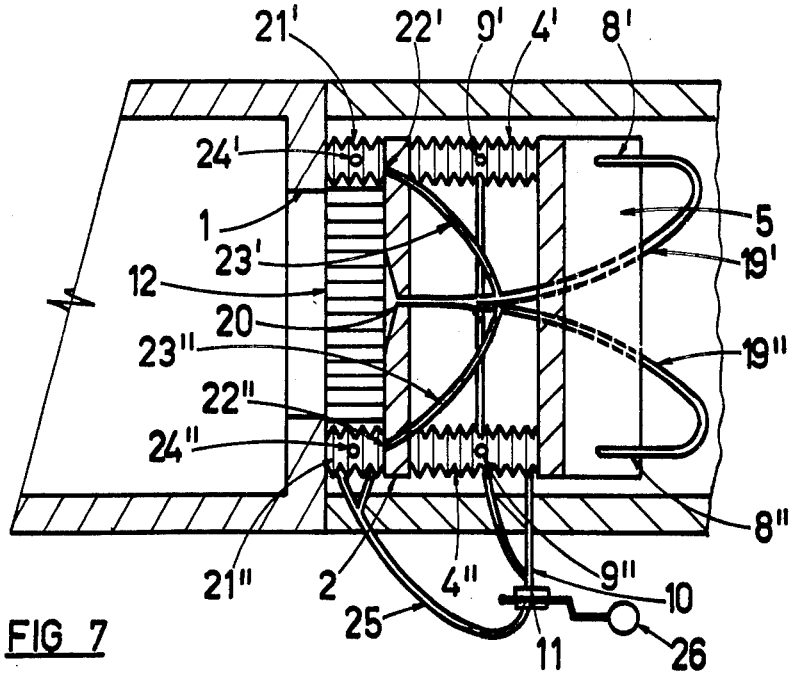
FIG. 7 is a diagrammatic sectional view of the fluid flow control means shown in FIG.6 along the line VII—VII of FIG. 6.
Figure 8:
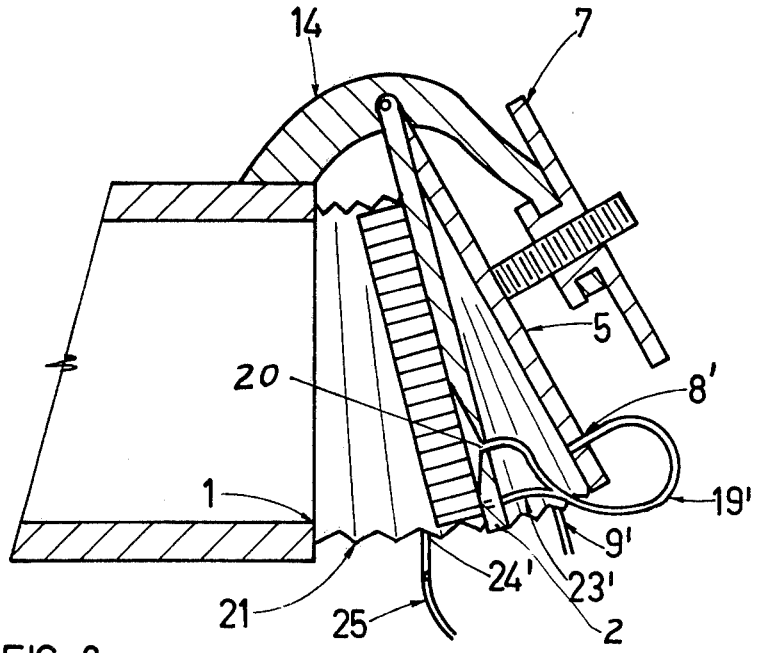
FIG. 8 is a diagrammatic mid-sectional view of the fluid flow control means shown in FIG. 6 but in the open or flow position.

A further form of fluid flow control means according to the present invention is envisaged and shown in FIGS. 6–8. In this arrangement like parts to those shown in FIGS. 1–3 are indicated by the same reference numerals. A collapsible member 4 provided between the restraining means 5 and the flap member 2 is in this arrangement used in the form of two bellows or bags 4′ and 4″, each provided with an inlet 8′, 8″ extending through the restraining means 5 and an outlet 9′, 9″ leading from the bellows to a conduit 10 in which control valve 11 is provided and indicated by way of example only as a float valve. The inlets 8′,8″ through the restraining means 5 are fed by conduits 19′, 19″ from a passage 20 extending through the flap member 2 from the upstream face 2A thereof and are positioned within the space between the two bellows or bags 4′,4″.

A filter 12 is positioned centrally of the upstream face 2A and over the passage 20. In this arrangement an extra or secondary collapsible member, in the form of a pair of bags or bellows, 21′, 21″ is positioned on the upstream face 2*a* of the main flap to either side of the centrally disposed filter 12 and these are each connected by a small inlet pipe 22′, 22″ respectively to the upstream water via passage 20 and conduit 23′, 23″, and outlets 24′, 24″ from the bellows 21′,21″ respectively are provided and having a greater outflow than the inflow through 22′. Outlets 24′, 24″ are drained by a pipe 25 which passes preferably through the side of the irrigation race to control valve 11, being the same valve controlling the outlets 9′, 9″ of the primary bellows 4′, 4″. The control valve 11 on receiving a pressure signal from a water sensing device such as the float 26 (shown by way of example only) closes the conduit 10 from the primary bellows 4′, 4″ and opens the pipe 25 connected to the secondary bellows 21′, 21″. This causes water pressure to build up on the downstream face 2*b* of the flap member 2 and causes a low pressure air space to be formed in the upstream face 2*a* of the flap member 2. The result of these two pressures is a closing force on the flap member 2. When the water in the paddock seeps away into the ground the water level sensing device reverses the position of the control valve 11 and the flap member 2 moves into a partly open position awaiting the next water flow.

The invention can be also applied to an irrigation system including an inclined water race having a series of transversely disposed dividing walls at spaced intervals along the length of the race to form separate race sections each having a side wall sill over which water can spill into an adjacent area or paddock to be irrigated, each dividing wall constituting a race gate and having an opening provided with a flap control means.

Figure 9:
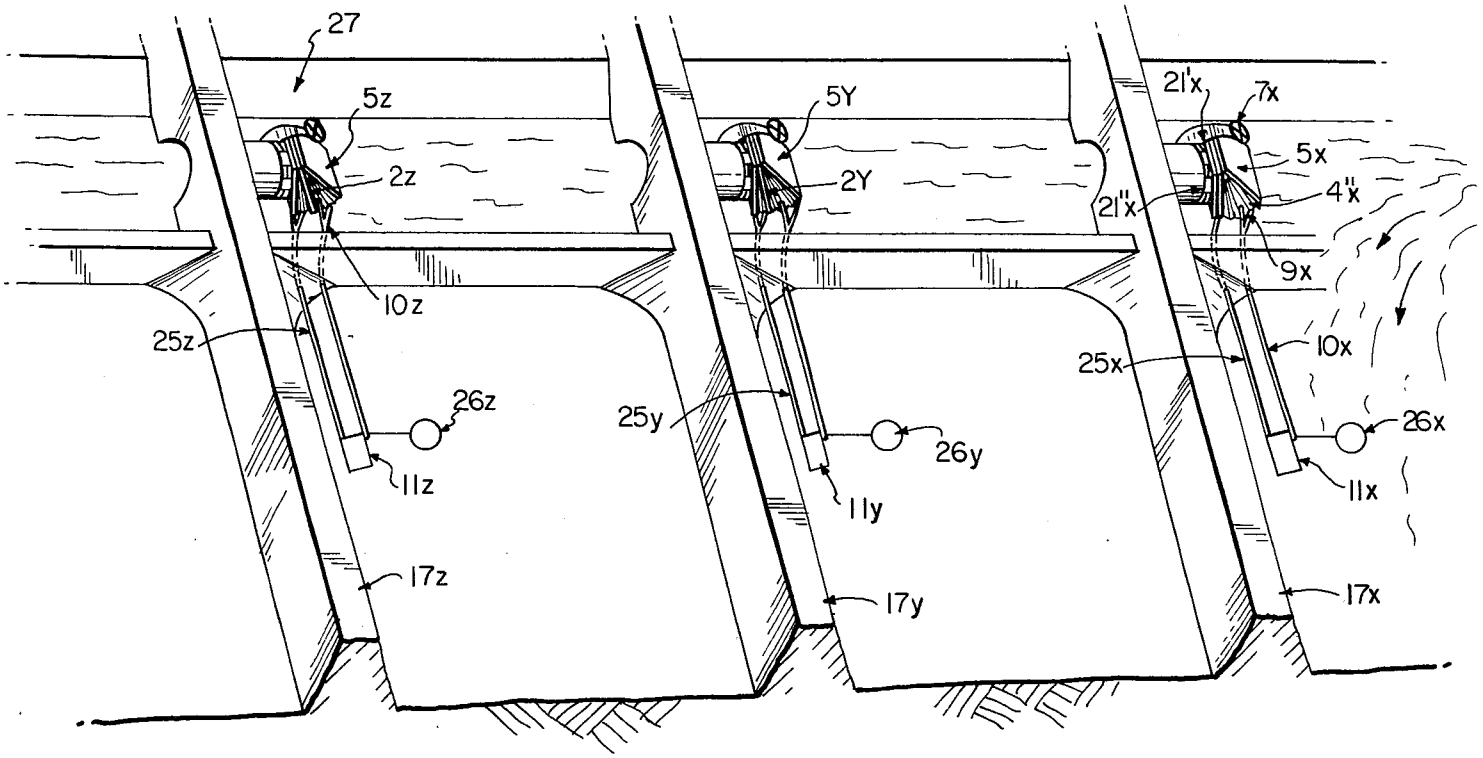
FIG. 9 is a diagrammatic perspective view of a water race of the Border Dyke type with a gradient and incorporating a series of fluid flow control means of the kind shown in FIGS. 6–8, and FIGS. 10 and 11 are a diagrammatic mid-sectional view and a plan view, respectively, illustrating a further modification and application of the invention for water flow in water course.

This form of irrigation and fluid flow control means according to the present invention is illustrated in FIG. 9 applied as race gates for a water race 27 with a down gradient. In this arrangement the lower section of the race gate gets the water first and there it banks up and spills over the sill of the race into paddock X and when the water in the paddock X backs up toward the race the float valve 24X which is to the side of the sill will actuate the control valve 11X to close off the flow from the primary bellows 4X, 4′X to enable the build-up of pressure therein and the drainage of the secondary bellows 21′X, 21″X to produce low pressure air spaces therein, the combined effect closing the flap member 2X and hence the flow into the paddock X. FIG. 9 illustrates the partial closing of the race gate for paddock X with the race gates for paddocks Y and X being fully open. When the race gate for paddock X has completely closed the water will then build up in the next highest section and spill over the sill into paddock Y and repeat the process whereby as the water in the paddock gradually backs up towards the race and raises the float 26Y and thus actuates the control valve 11Y. the race gate for paddock Y will then close and enable the water to bank up in the next highest section and overflow into paddock Z. In this way the race gates are actuated in sequequence one after the other.

It is believed that the fluid flow control means according to the present invention in its various forms is suitable for many and various applications in particular in the field of irrigation and water reticulation and control and within this field in many forms and applications other than those described above. It will be appreciated that many modifications of the arrangement shown and described above are envisaged within the scope of the invention.

For example if desired the sensors may be positioned near the race within the paddocks being irrigated or far down the paddocks but it is also envisaged that a moisture sensing or flow device could be provided on the race gate arrangement itself such as for example on the back of the restraining member 5, whereby the race gate would be closed when the water level being controlled had risen to immerse or partly immerse the race gate. It is also envisaged that such an arrangement could be used in conjunction with any other flow sensing or water level sensing devices in the paddocks to act as a failsafe device.

It is also envisaged that any suitable indicating means could be provided for the gate to give an operative positioned some distance away from the race an indication as to which gate is open or closed. Such means are for example a flag indicating mechanism on the flap which can be viewed through binoculars or a high tension or electric impulse giving an audible or visible alarm actuated upon opening or closing of the gate as desired.

It is also envisaged that the race gates could be fully portable as described earlier and also that any hydraulic linkage from float valves positioned down the paddock could be portable and run out each time that the gates are attached to the race.

It is also envisaged that the fluid flow control means according to the present invention may be expected to act above water level or fully or partially immersed. It may however be necessary to include counter-balancing mechanism or float means to assist the closing of the race gates under water and possibly with the fluid flow control means that are to be fully immersed the type having the secondary bellows incorporated therein would give a more positive cut-off of the fluid flow.

Figure 10:
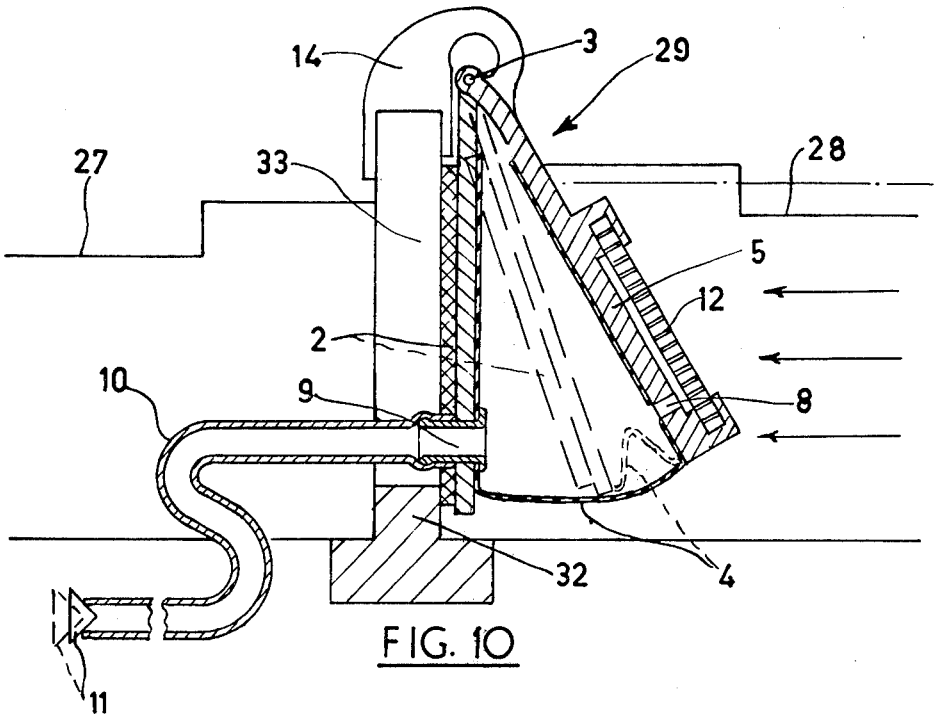
Figure 11:
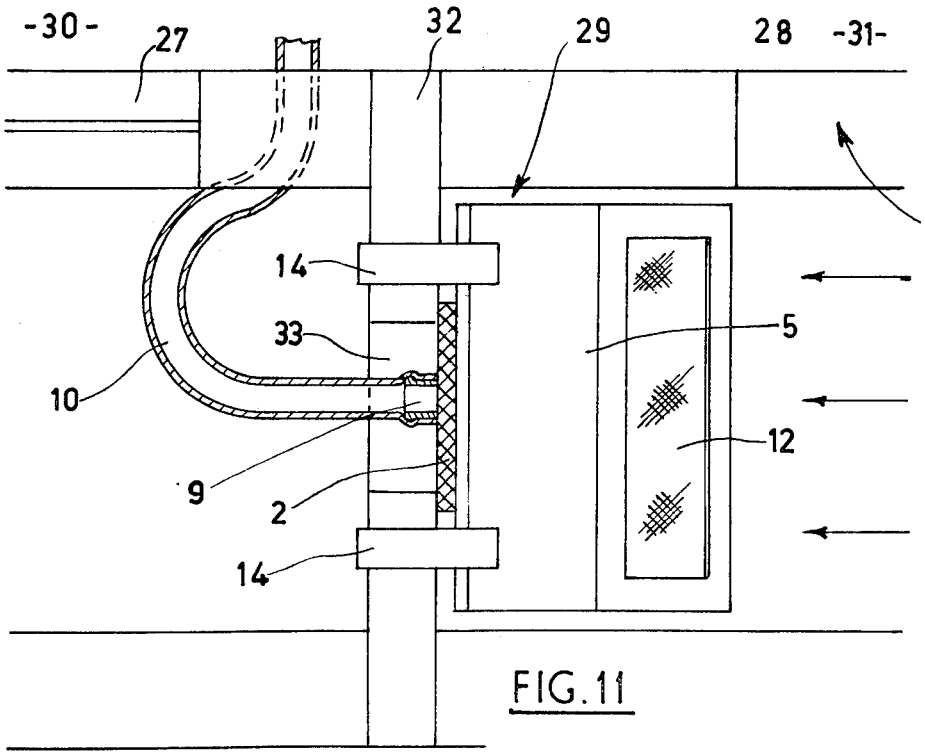

The aforedescribed embodiments of the invention are concerned with constructions in which the flap member 2 is located on the downstream side of an outlet from or opening in a water course, and in which the flap member 2 is movable against the direction of water flow towards the outlet or opening to close or substantially close such outlet or opening in stopping or retarding the fluid flow therethrough. In a further alternative embodiment of the invention the flap member 2 can be located on the upstream side of the outlet or opening and movable towards such outlet or opening in the same direction as the fluid flow to close off or retard the fluid flow through the outlet or opening. An example of such an alternative embodiment and its application is illustrated in FIGS. 10 and 11 of the drawings and includes a water race for an irrigation system having a wall with at least two different water spill-over levels 27 and 28, and a control gate (generally indicated by the arrow 29) between the two levels 27 and 28 whereby water travelling down the race and through the gate 29 will first spill over the lower level 27 to irrigate an adjacent area 30 and on closing of the gate 29 will then build up and spill over the next higher level 28 to irrigate a next adjacent area 31, and so forth.

The gate 29 includes a transverse wall or abutment 32 having an opening 33 through which water can pass along the race and the flap member 2 is located on the upstream side of the abutment 32 and opening 33 and depends from a transverse upper pivot connection 3, as in the previously described embodiments, but so as to be pivotally movable towards and away from the opening 33 on the upstream side. The restraining member or plate 5 extends downwardly from its support 14 and upstream of the flap member 2, and is at least normally secured against movement but may be adjustable as in the previously described and illustrated constructions, and the collapsible bag or bellows member 4 is again located between the flap 2 and restraining member 5. In this arrangement the inlet 8 to the collapsible chamber defined by the bag or bellows member 4 (alone or in conjunction with the flap 2 and restraining member 5) is provided in the restraining member 5 and the outlet 9 (of greater flow capacity than the inlet 8) is provided in the flap member 2. A filter member 12 is preferably again provided at the upstream side of the inlet and thus in this case will be mounted on the upstream side of the restraining member 5. The conduit 10 connected to the outlet 9 will extend into the lower area 30 to be irrigated and will be provided with the control valve means 11 for closing the outlet 9 (when operated in any of the manners previously described) when area 30 has been irrigated so that the collapsible chamber will fill with water and close the flap member 2 over the gate openings 33 when the internal pressure reaches that exerted by the upstream flow of water. In FIG. 10 the flap member 2 and collapsible member 4 are shown in full in the gate closed position and in broken outline in the open position. When the lower area 30 is dry and the control valve means 11 open or opened, water in the collapsible chamber can escape faster through outlet 9 than filling can take place through inlet 8, and thus water pressure on the downstream face of the flap member 2 will exceed that within the chamber and cause the flap member 2 to move upstream and allow water from the upstream side to pass through opening 33 for irrigation of the lower area 30. In the event that the lower part of the race (on the downstream side of the flap member) is initially dry biassing weight or other means can be employed to normally urge the flap member 2 upstream against vertical (and thus closing) bias inherent in the suspended flap member 2 to thus initiate opening, although this may not be necessary in the form of the invention illustrated as the external upstream water pressure on the collapsible member 4 will be greater than the pressure within the chamber and thus the collapsible member 4 will be pushed inwardly to draw the flap member 2 open.

Particular embodiments of the invention have been described and illustrated by way of example but it will be appreciated that still further embodiments and applications of the invention may take place without departing from the scope of the appended claims.

I claim:

1. Fluid flow control means comprising a flap member mountable across the flow path of the fluid which is to be controlled, and movable to effect control of said flow, at least one collapsible member defining a collapsible chamber and arranged to act on said flap member, said chamber having an inlet means in flow communication with the upstream flow and an outlet means arranged to enable the fluid flow leaving the chamber to be greater than the fluid flow into the chamber, secondary control means actuable to close off said outlet in response to the existence of a predetermined amount or level of fluid at a predetermined position downstream of said flap member, so that fluid is able to accumulate in the chamber and the accumulated fluid is able to act on an adjacent face of said flap member and to move said flap member to a position closing off or substantially retarding said fluid flow.

2. Control means as claimed in claim 1 wherein the collapsible member is flexible and is sandwiched between the flap member and a substantially rigid restraining member, the flap member being on the upstream side of the collapsible member and the restraining member being downstream of the flap member and arranged to be secured against movement.

3. Control means as claimed in claim 1 wherein the flap member is secured to the upstream side of the collapsible member and a substantially rigid restraining member is secured to a downstream side of the collapsible member, said restraining member being securable against movement.

4. Control means as claimed in claim 3, wherein the flap member and restraining member depend from a common upper horizontal pivot connection.

5. Control means as claimed in claim 1 wherein the inlet means to the collapsible chamber is an inlet passage extending through the flap member.

6. Control means as claimed in claim 1 wherein the pressure area on the downstream face of the flap member on which pressure build-up in the collapsible member can act is greater than the pressure area on the flap member upstream face on which the upstream fluid pressure can act when the flap member is in the fully closed position.

7. Control means as claimed in claim 1 wherein the flap member depends from an upper horizontal pivot connection and counter-balance means is provided on the upper pivotally connected end part of the flap member to facilitate opening of such flap member.

8. Control means as claimed in claim 1 wherein the flap member depends from an upper horizontal pivot connection and a float member is attached to the upper part of the upstream face of the flap member to facilitate positive closing of the flap member.

9. Control means as claimed in claim 1 wherein the flap member extends across an opening of a water race wall for an irrigation system and the secondary control means includes a valve to close the collapsible member outlet and operating means actuable by water for effecting closing of the valve.

10. Control means as claimed in claim 9 wherein the operating means includes a float arranged, when raised by water from the water race, to exert pressure on collapsible means containing liquid and transmit such pressure by way of a connecting conduit to a further collapsible and expansible means near the outlet and cause such further means to expand and act on and close the valve and outlet.

11. Control means as claimed in claim 9 wherein the operating means includes a housing containing a bellows and a moisture absorbing and swelling element arranged to act on and compress the bellows on absorption of water, the bellows containing a liquid and being connected by a conduit to a second bellows near the outlet and cause such further bellows to expand and act on and close the valve and outlet.

12. Control means as claimed in claim 9 wherein the opening in the water race wall is the first of a series of openings in such wall for a series of separated areas to be irrigated in sequence, and the operating means is in the first area and is arranged, on closing the first valve, to effect opening of a previously closed further valve for the outlet of a similar control means for the next area to be irrigated, to permit opening of the flap member of such next similar control means.

13. Control means as claimed in claim 2 wherein there are two similar collapsible members in spaced relationship and in the form of primary bellows for effecting movement of the flap member to the fluid flow close off or retarding position, the outlets from both bellows communicating with a common outlet closable by a control valve of the secondary control means and the inlets to the two bellows being by way of conduits extending from a common inlet in the upstream face of the flap member to and through the downstream face of the restraining member.

14. Control means as claimed in claim 13 wherein a pair of similar secondary collapsible bellows are mounted in spaced relationship between the flap member and abutments at either side of the fluid flow path across which the flap member extends, said secondary bellows each having an inlet in communication with the main inlet for the primary bellows and an outlet of greater fluid flow capacity than the secondary bellows inlet and communicating with a common outlet to the control valve of the secondary control means, said control valve being arranged to close the outlet from the primary bellows whilst opening the outlet from the secondary bellows, and vice versa.

15. Control means as claimed in claim 3 wherein there are two similar collapsible members in spaced relationship and in the form of primary bellows for effecting movement of the flap member to the fluid flow close off or retarding position, the outlets from both bellows communicating with a common outlet closable by a control valve of the secondary control means and the inlets to the two bellows being by way of conduits extending from a common inlet in the upstream face of the flap member to and through the downstream face of the restraining member.

16. Control means as claimed in claim 15 wherein a pair of similar secondary collapsible bellows or bags are mounted in spaced relationship between the flap member and abutments at either side of the fluid flow path across which the flap member extends, said secondary bellows each having an inlet in communication with the main inlet for the primary bellows and an outlet of greater fluid flow capacity than the secondary bellows inlet and communicating with a common outlet to the control valve of the secondary control means, said control valve being arranged to close the outlet from the primary bellows whilst opening the outlet from the secondary bellows, and vice versa.

17. The control means as set forth in Claim 9, including a substantially level water race having a series of water outlets in a side wall thereof for the individual and sequential supply of water to a series of separated areas to be irrigated, each outlet being provided with the fluid flow control means, and the secondary control valve operating means in the first area being arranged, on closing of the first area outlet valve, to effect opening of a previously closed further valve for the outlet of the second control means for the second area of the series to permit opening of the flap member of such second control means, subsequent operation of the second area secondary control valve operating means being arranged, on closing of the second area outlet valve, to similarly effect opening of a previously closed further valve for the outlet of the third control means and so on for the full series of areas to be irrigated.

18. The control means as set forth in Claim 9, including an inclined water race having a series of transversely disposed dividing walls at spaced intervals along the length of the race to form separate race sections each having a side wall sill over which water can spill into an adjacent area to be irrigated, each dividing wall constituting a race gate and having an opening provided with the fluid flow control means.

19. Control means as claimed in claim 1, wherein the collapsible member is a sandwiched between the flap member and a substantially rigid restraining member, the flap member being pivotally suspended on the upstream side of an opening in the fluid flow path so as to be movable from an open, free flow position spaced from said opening towards and closing said opening for closing off or retarding fluid flow, said restraining member being located upstream of the flap member and arranged to be secured against movement.

20. Control means as claimed in claim 19 wherein the inlet means to the collapsible chamber is provided by way of an inlet opening through the restraining member.

21. Control means as claimed in claim 19 wherein the outlet means is provided by way of an outlet opening through the flap member.

22. The control means according to claim 19, including a water race having at least two different wall levels along its length at which water can overflow into an adjacent area to be irrigated, a closable opening being provided in an abutment extending transversely of the race between the two different levels and control means provided at each transverse opening.

* * * * *